US005702044A

United States Patent [19]

Christmann et al.

[11] Patent Number: 5,702,044

[45] Date of Patent: Dec. 30, 1997

[54] STOP PIECE

[75] Inventors: Norbert Ernst Christmann, Breidenbach; Gerhard Fries, Biedenkopf, both of Germany

[73] Assignee: Tetra Laval Convenience Food GmbH & Co. KG, Biedenkopf-Wallau, Germany

[21] Appl. No.: 679,535

[22] Filed: Jul. 12, 1996

[30] Foreign Application Priority Data

Jul. 13, 1995 [DE] Germany ..... 195 25 523.2

[51] Int. Cl.[6] ..... B65H 20/00; B65G 47/84; F16D 1/00

[52] U.S. Cl. ..... 226/173; 198/803.7; 403/327; 403/375

[58] Field of Search ..... 226/170, 173; 403/331, 327, 326, 375; 198/803.7

[56] References Cited

U.S. PATENT DOCUMENTS

| | | | |
|---|---|---|---|
| 969,295 | 9/1910 | Meahl | 226/173 |
| 1,460,538 | 7/1923 | Easton | 403/331 X |
| 2,237,877 | 4/1941 | Fulk | 226/173 X |
| 3,536,184 | 10/1970 | Myers | 198/803.7 |
| 4,113,397 | 9/1978 | Snyder | 403/326 X |
| 4,397,411 | 8/1983 | Vetter et al. | 226/173 |
| 4,601,421 | 7/1986 | Natterer et al. | 226/173 |
| 4,826,065 | 5/1989 | Natterer et al. | 226/173 |
| 5,364,201 | 11/1994 | LaBarre | 403/327 X |

FOREIGN PATENT DOCUMENTS

| | | |
|---|---|---|
| 2 484 381 | 12/1981 | France . |
| 2 355 921 | 5/1975 | Germany . |
| 24 30 497 | 1/1976 | Germany . |
| 3 315 419 | 10/1984 | Germany . |

*Primary Examiner*—Michael Mansen

*Attorney, Agent, or Firm*—Flynn, Thiel, Boutell & Tanis, P.C.

[57] ABSTRACT

A movable spring end of a compression spring being stopped on a guide spindle by a special stop piece. The stop piece which is designed nonelastic and can therefore be manufactured of a nonrusting material, it thereby guarantees a hygienically satisfactory device, in particular when contacting food. The stop piece can be used particularly advantageously in tensioning pieces on conveyor chains, which are suited for the transport of packaging foil bands in packaging machines.

18 Claims, 2 Drawing Sheets

STOP PIECE

FIELD OF THE INVENTION

The invention relates to an annular stop piece for the movable spring end of a cylindrical compression spring encircling a coaxial guide spindle, wherein the stop piece is provided, axially oriented, in a radial, concentrical holding groove of the guide spindle, in particular for a tensioning piece loaded by the compression spring and releasable against its spring force on a conveyor chain for tensioning and subsequent transporting of a packaging foil band into a packaging machine, and a tensioning piece provided with such a stop piece.

BACKGROUND OF THE INVENTION

It is most of all necessary during the transport of packaging foil bands, which can be welded together, and in which goods to be packaged are supplied in measured doses between a lower and an upper foil and is manufactured into marketable portions by welding the lower and upper foil together, to tension the packaging foil bands and move them at the same time, as described, for example, in the Offenlegungsschrift (German Patent No.) DE 24 30 497. The constantly changing tensioning and releasing of the packaging foil band demands a mechanism with which these operations can be carried out with simple means and great safety. Link chains have thereby been particularly successful, in which each link is provided with a suitable tensioning piece, which is opened when a first chain wheel passes under it so that meanwhile the edge grips and tensions a packaging foil band, and which in the same manner when a second chain wheel passes under it is again opened, whereby the packaging foil band (processed in the meantime) is released.

The thereby utilized tensioning pieces, which open and/or close during passage under the chain wheels, use tensioning elements as a rule which are moved against the force of compression springs by means of a pressure bolt when a chain wheel is being passed over. It is understood that the necessary tensioning forces on the packaging foil bands must always be chosen to be very large in order to guarantee a satisfactory clamping, during which also a deformation of the packaging foil band must be possible.

In particular, the movable spring end of the compression spring must therefore be stopped by a highly strong stop piece. It is known to provide for this purpose, a snap ring in the guide spindle, on which ring rests the spring end. However, snap rings are manufactured of an elastic and rustable spring steel. When the material to be packaged is food, the use of such a snap ring is not desirable for hygienic reasons.

Moreover, a snap ring does not offer sufficient safety so that it will not come loose from the guide spindle, for example, when it is insufficiently mounted and is not provided with the needed tensioning force on the guide spindle, which is the case when the diameter at the base of the holding groove lies outside of the necessary tolerance suited for the snap ring. Regardless of whether this diameter is too small or too large, the snap ring can then during operation move out of the area of the guide spindle and can bring about the sudden relaxation of the tensioning piece, which can thereby result in damage to the associated feeding mechanism. A test whether the snap ring is orderly mounted under initial tension is not possible with simple means suited for a machine shop operation or is too expensive. An orderly assembly depends therefore, in an undesired manner, on the skills and conscientiousness of the installation personnel.

OBJECTS OF THE INVENTION

The purpose of the invention is therefore to provide an annular stop piece of the general type described in detail above so that it can be used without worries when it comes into contact with food, and which furthermore after its assembly with the guide spindle forms a very secure stop for the movable spring end of the compression spring without having to place particular demands on the skill and reliability of the installation personnel. Its installation, for example into a tensioning piece, alone is supposed to already guarantee that the stop piece, even during a continuously high dynamic operation and thereby constantly changing loading and unloading, and any desired length of operation, safely orients the movable spring end of the compression spring. Nevertheless, the stop piece is still intended to be able to be inexpensively manufactured and is not intended to require any additional space and installation maintenance.

The purpose is attained according to the invention in such a manner that the stop piece consists of a flat, circular base plate and an annularly cylindrical collar pointing in direction of the spring on the outer edge of the base plate and at least mostly enclosing the spring end. The inner edge of the base plate, which edge rests on the base of the holding groove, is connected to the outer edge through a feed slot, whereby the width of the feed slot is adapted to the diameter at the base of the holding groove and is dimensioned such that the stop piece can be moved without jamming onto the base of the holding groove. The collar is, in a preferred embodiment, formed by a flange on the outer edge of the base plate.

Such a compactly designed stop piece can be manufactured in a simple manner as a stamped and bent component, and very cost effectively. It is held in place, after its installation, by the compression spring itself. The stop piece is loaded only axially by the spring force. Lateral forces, which may possibly occur on it, are not able to move the stop piece out of its center position, because it is securely centered through the collar and the spring end. For this reason a complete installation is also guaranteed with a high degree of reliability. The spring end can only (clearly visible!) be lowered within the collar onto the base plate when the stop piece is moved with its feed slot so far in to the holding groove that the inner edge of the base plate is directly adjacent to the base of the holding groove. In the case where the installation is incomplete, the spring end is not within the collar but rests, well visible, on the same, it is an indication that the assembly did not occur properly.

It is advantageous when the collar is interrupted parallel and symmetrically with respect to the feed slot through a recess, the width of which is at least equal to the diameter of the guide spindle and preferably slightly greater than same. The stop piece can, in this matter, be installed independently of the width of the holding groove and the holding groove can fall below the total height of the stop piece with collar and can be designed only slightly larger than the thickness of the base plate.

A hygienic design of the stop piece is guaranteed when it consists of a nonrusting, food-physiologically indifferent material, preferably steel.

It is particularly advantageous when the deformation resistance of the stop piece, which resistance is determined by the dimension and material, is chosen such that an elastic or permanent deformation under the longlasting influence of the compression spring is eliminated. An initial-tensioning force of the compression spring, which force is unchanged on a long term basis, is secured in this matter. The initial-tensioning force can be chosen very high so that a correspondingly high tensioning force can be produced when the stop piece is, for example, used on a tensioning piece loaded by the compression spring and releasable against its spring force.

Such a tensioning piece, in particular for use on a conveyor chain for tensioning and subsequent transport of a packaging foil band, is advantageously provided on a chain link of a conveyor chain designed as a link chain.

The arrangement can advantageously be such that the guide spindle is supported axially movable transversely with respect to the feeding direction on a U-shaped bearing block consisting of a holding plate fastened on the chain link and two bearing plates, whereby the compression spring hits the stop piece and also a bearing plate. A clamping piece rests on the outside of the bearing plate for clamping the packaging foil under the action of the compression spring. The clamping piece is designed in one piece with the guide spindle, and can be lifted off against the action of the compression spring when the guide spindle is loaded on an axially aligned pressure bolt guided through the other bearing plate and projecting over same, for example, by an annular cam on a chain sprocket for the link chain. Such an arrangement is used very advantageously by the stop piece of the invention, which has itself a simple design so that tensioning pieces of this type can be manufactured inexpensively in large numbers and can be mounted on the chain links of a link chain. The requirements for the stop piece to be inherently stable and rigidly constructed and to use a nonrusting steel are realized with very little expense so that the tensioning piece can be utilized as a whole without any concerns when packaging food items.

It is advantageous for the installation of the stop piece when the width of the holding groove on the guide spindle is at least equal to, preferably however, at least slightly greater than the thickness of the base plate, and when, if desired, the holding groove is provided on the guide spindle so that when the clamping piece rests on the first bearing plate the stop piece is at least slightly spaced from the second bearing plate.

The invention can at all times be used advantageously when very high initial-tensioning forces of the compression spring must be controlled on tensioning pieces of the described type, however, it is by no means limited thereto. The stop piece of the invention is, in general, suited as a locking of a spring end of a compression spring on a guide spindle or the like.

BRIEF DESCRIPTION OF THE DRAWINGS

The invention will be discussed hereinafter in greater detail in connection with one exemplary embodiment illustrated in the drawings, in which.

DETAILED DESCRIPTION

Figure 2:
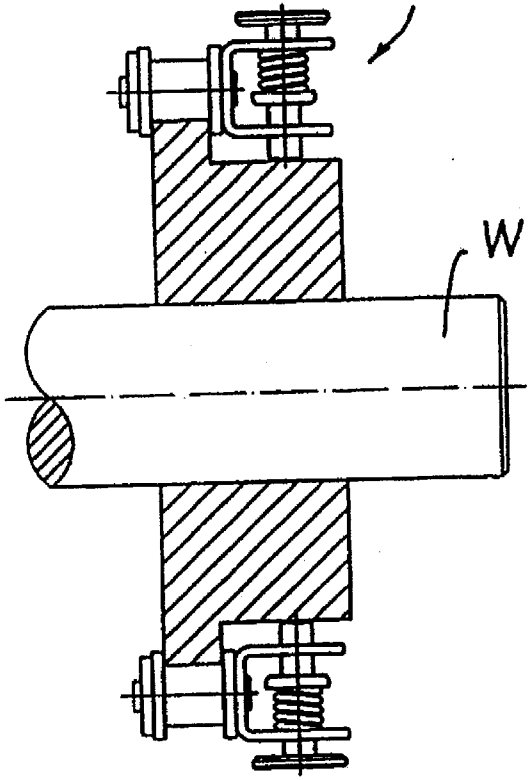
FIG. 2 is a side view of FIG. 1 in the cross section II—II.
Figure 1:
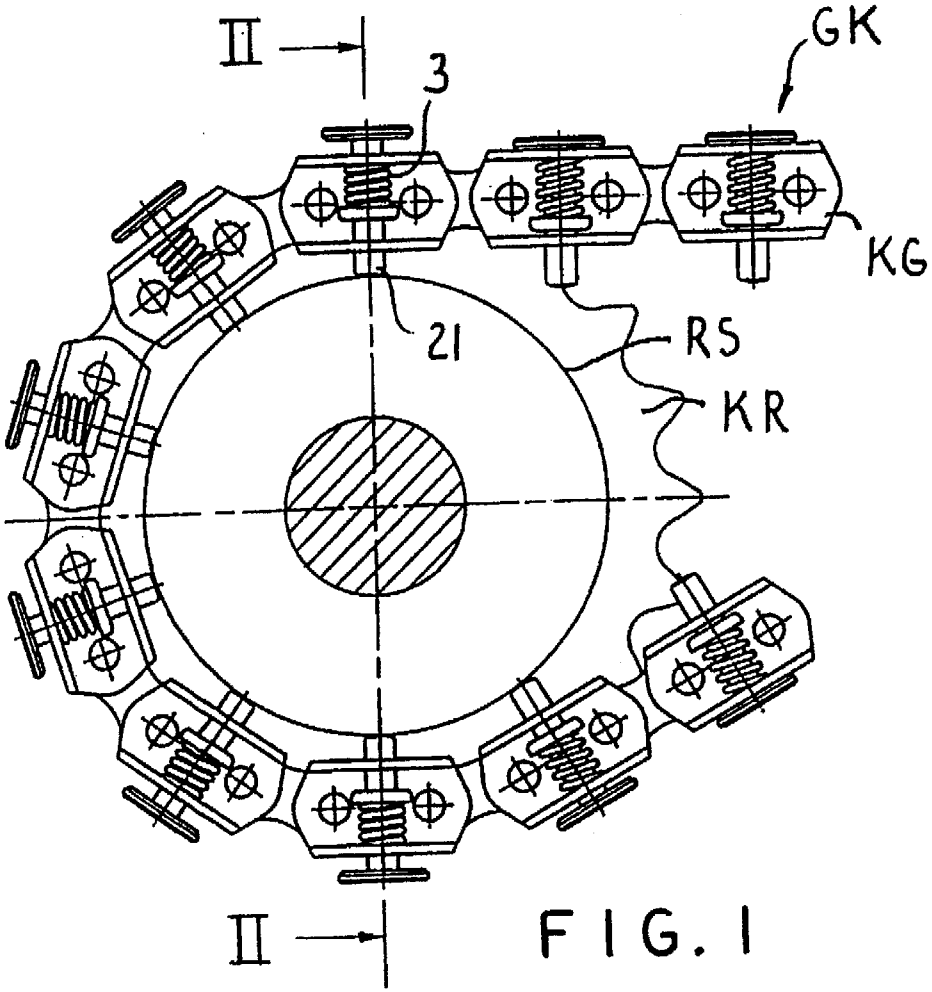
FIG. 1 is a front view of a link chain for the transport of a packaging foil band or the like in the area of a chain wheel.

FIGS. 1 and 2 show a link chain GK, which is suited for driving a packaging foil band, in the area of a chain wheel KR supported on a stationary shaft W, which link chain is composed of individual chain links KG. A tensioning piece S is fastened to each chain link KG, as this is shown in detail with FIGS. 3 and 4.

The tensioning piece S consists accordingly of a bearing block 1, which can be fastened, for example riveted, to the associated chain link KG, a guide spindle 2, a compression spring 3 and a stop piece 4 fastened to the guide spindle 2.

Figure 3:
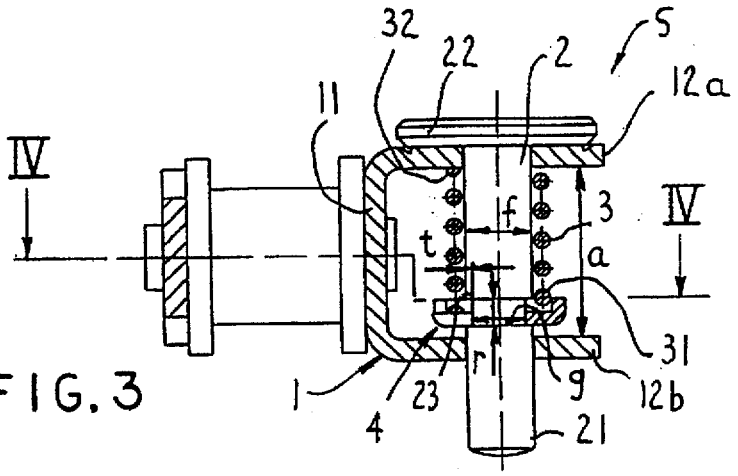
FIG. 3 shows a slightly enlarged chain link of FIG. 2 with the tensioning piece being in a relaxed state.

The bearing block 1, which in the front view of FIG. 3 is U-shaped and is formed from a sheet-metal plate, is assembled in one piece into a holding plate 11 resting on the chain link KG. The holding plate 11 has two spaced and parallel bearing plates 12*a*, 12*b* for supporting the axially limitedly movable guide spindle 2.

The guide spindle 2 includes an elongated pressure bolt segment 21 at one end and an enlarged clamping piece 22 at the opposite end. While the clamping piece 22 rests, under the load of the compression spring 3 encircling the guide spindle 2, on a first bearing plate 12*a*, when the associated chain link KG is outside the area of the chain wheel KR, it can be lifted off from the bearing plate 12*a* when the chain link KG is pulled into this area. As can be easily recognized in FIG. 1, the pressure bolt 21 moves thereby into the active area of an annular cam surface or ridge RS constructed in one piece on the chain wheel KR and is lifted in this active area against the spring force of the compression spring 3. For example, a packaging foil band, which is to be clamped, can now be moved between the clamping piece 22 and the bearing plate 12*a* and becomes clamped when the chain link KG has again left the area of the chain wheel KR; the removal of the packaging foil band from the tensioning pieces S takes place similarly at a further chain wheel.

An annular holding groove 23 is provided on the guide spindle 2 adjacent to the pressure bolt segment 21 and in the vicinity of the bearing plate 12*b*, into which holding groove the stop piece 4 is received and is axially restrained. The compression spring 3 is thereby clamped with a high initial tension between the bearing plate 12*a* and the stop piece 4. The dimensions of the holding groove 23 are determined by the diameter "g" of its base 23*a* and its height "t."

Figure 4:
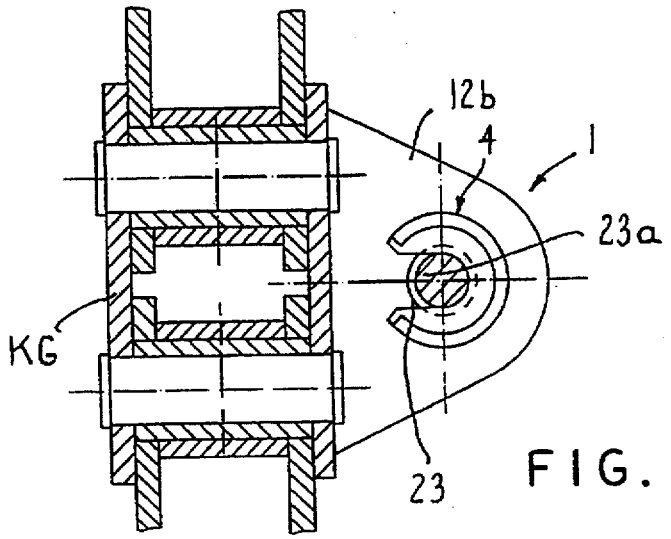
FIG. 4 is a cross-sectional view IV—IV of FIG. 3, and FIGS. 5*a* to 5*c* show views of the stop piece of the invention, again enlarged when compared with FIGS. 3 and 4, all in a schematically simplified illustration.
Figure 5A:
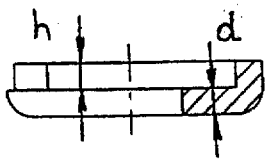
Figure 5B:
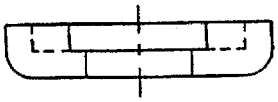
Figure 5C:
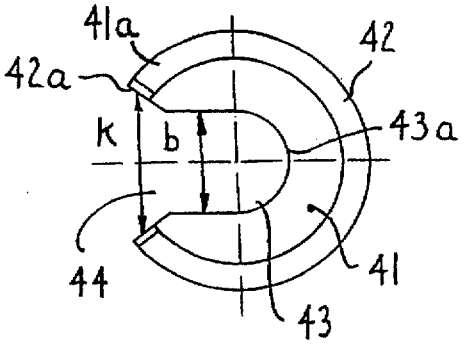

The cross section of FIG. 4 shows how the stop piece 4 can be moved into the holding groove 23. The stop piece 4 is composed in one piece of a circular base plate 41 and having an upstanding annular collar 42. The annular or cylindrical collar 42, which has a height "h" is bent out of the base plate 41 and encircles the movable spring end 31 of the compression spring 3. The other spring end 32 of spring 3 rests on the bearing plate 12*a*. The details of the stop piece 4 are illustrated in FIG. 5*a*–5*c*. An (inner) edge 43*a* of a center opening 43 adapted to the diameter "g" of the base 23*a* of the holding groove 23 is connected through a feed slot 44 to the (outer) edge 41*a* of the base plate 41 and is otherwise designed semicircularly. The width b of the feed slot 44 is dimensioned such that the stop piece 4 can be moved easily, however, without much clearance into the holding groove 23. The mounting of the stop piece 4 is made easier when the collar 42 ends symmetrically with respect to the feed slot 44 and is angularly set back on both sides with respect to it. The recess 42*a* of the collar 42 designed in this manner has here a width "k," which is slightly greater than the diameter "f" of the guide spindle 2 so that a jamming during the mounting is avoided.

In spite of the opening 43 and of the feed slot 44, the stop piece 4 is, because of the upstanding collar 42, extraordinarily inherently stable. It is held securely in situs in the mounted state because of the spring end 31, which rests on the base plate 41 and is enclosed by the collar 42.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A tensioning piece in a food packaging transporting device, comprising at least two spaced apart plates extending from a conveyor chain, each of said plates having a bore therethrough coaxially aligned with each other, a guide spindle coaxially received in said bores, an annular holding groove being provided in a periphery of said guide spindle intermediate said plates, a stop piece received in said groove, and a compression spring encircling said guide spindle and providing a spring force for clamping and subsequent transporting of a packaging material, one of said plates and said stop piece forming abutments for said spring, said stop piece comprising, (a) a flat, base plate having an outer edge and an annularly cylindrical collar extending coextensively with said spring and being oriented adjacent said outer edge of said base plate and enclosing at least a portion of one end of said spring; and (b) said base plate having an inner edge resting in said annular holding groove, a feed slot extending through said base plate from said outer edge to said inner edge of said base plate, a width of said feed slot being conformed to a diameter of said annular holding groove and said feed slot being dimensioned such that said stop piece is freely movably without becoming jammed in said annular holding groove.

2. The tensioning piece according to claim 1, wherein said collar is formed by a flange extending from said outer edge of said base plate.

3. The tensioning piece according to claim 1, wherein a recess interrupts said collar symmetrically about said feed slot, said recess having a width at least equal to a diameter of said guide spindle.

4. The tensioning piece according to claim 1, wherein said stop piece consists of a nonrusting, food-physiologically indifferent material.

5. The stop piece according to claim 1, wherein said stop piece is sufficiently dimensioned to resist an elastic or permanent deformation under the long-lasting influence of the compression spring.

6. The tensioning piece according to claim 1, wherein said conveyor chain is a link chain and said plates extend from chain links in said link chain.

7. The tensioning piece according to claim 6, wherein said conveyor chain travels in a feeding direction for transporting packaging material, and wherein said at least two spaced apart plates are parallel and are included in a U-shaped holding bearing plate fastened on said chain link at a bight portion thereof, wherein said compression spring abuts at its respective ends said stop piece and said one plate, said guide spindle including a clamping piece for gripping the packaging material under said spring force of said compression spring, said clamping piece being located on a side of said one plate remote from said compression spring, and said clamping piece being fixed to said guide spindle and axially movable therewith for releasing the packaging material against said spring force of said compression spring when said guide spindle receives an axial force acting toward said clamping piece.

8. The tensioning piece according to claim 7, wherein said holding groove is provided on said guide spindle such that when said clamping piece rests on said one plate, said stop piece is at least slightly spaced from said other plate.

9. The tensioning piece according to claim 7, wherein said guide spindle includes a bolt extending through said bores in said two plates, said bolt extending beyond an other of said at least two plates and to receive said axial force to cause an axial moving of said bolt and said clamping piece against the spring force of said spring.

10. The tensioning piece according to claim 1, wherein a width of the holding groove is one of at least equal to and at least slightly greater than a thickness of said base plate of said stop piece.

11. The tensioning piece according to claim 1, wherein a recess interrupts said collar symmetrically about said feed slot, said recess having a width slightly greater than a diameter of said guide spindle.

12. The tensioning piece according to claim 1, where said stop piece consists of a steel body.

13. A linked chain for clamping and transporting a food packaging foil band, comprising a plurality of chain links, a bearing block fastened to at least one of said plurality of chain links, said bearing block having a first plate and a second plate extending outwardly relative to said at least one chain link, said first plate and said second plate having bores therethrough, a guide spindle having a bolt segment axially movably received in said bores and a clamping segment positioned at an end of said bolt segment on one side of said first plate and is adapted to contact said one side of said first plate to thereby limit movement of said guide spindle in a first axial direction, said bolt segment having an annular groove axially spaced from said clamping segment, a stop piece received in said annular groove, said stop piece including a flat base and a collar extending generally transverse of said base and toward said plate, and a spring means for continuously urging said guide spindle in said first axial direction, said spring means abutting a second side of said first plate and said base of said stop piece said collar securing said spring means against radial displacement, whereby said clamping segment clamps a foil band against said one side of said first plate.

14. The linked chain according to claim 13, wherein said bearing block is essentially U-shaped including said first plate and said second plate extending from a bight, said second plate having said second bore therein axially aligned with said first bore in said first plate, said bolt segment coaxially extending through both of said bores in said first and second plates, and said U-shaped bearing block having an open side between said two plates providing ready visual confirmation of a secure and proper attachment of said stop piece in said groove.

15. The linked chain according to claim 13, wherein said base has an outer peripheral edge and an inner peripheral edge, and wherein said stop piece has a feed slot extending from said outer peripheral edge of said base to said inner peripheral edge of said base, said feed slot having a width slightly larger than a diameter of said bolt segment in the area of said groove such that said stop piece can be slid into said groove and onto said bolt segment without jamming.

16. The linked chain according to claim 13, wherein said spring urges said stop piece against a radially extending surface of said groove securing said stop piece on said guide spindle.

17. The linked chain according to claim 13, wherein each said chain link has one said bearing block fastened thereon.

18. The linked chain according to claim 13, wherein said base has an outer peripheral edge, and wherein said collar extends cantilevered from said outer peripheral edge of said base.

* * * * *